US005515707A

United States Patent [19]

Smith

[11] Patent Number: 5,515,707

[45] Date of Patent: May 14, 1996

[54] METHOD OF INCREASING THE FATIGUE LIFE AND/OR REDUCING STRESS CONCENTRATION CRACKING OF COILED METAL TUBING

[75] Inventor: Lawrence W. Smith, Humble, Tex.

[73] Assignee: Precision Tube Technology, Inc., Houston, Tex.

[21] Appl. No.: 275,444

[22] Filed: Jul. 15, 1994

[51] Int. Cl.[6] ..... B24C 7/00; B21J 1/00

[52] U.S. Cl. ..... 72/53

[58] Field of Search ..... 72/53; 29/90 A; 51/320

[56] References Cited

U.S. PATENT DOCUMENTS

| | | | |
|---|---|---|---|
| 2,164,267 | 6/1939 | Black . | |
| 2,214,618 | 9/1940 | Kenyon et al. . | |
| 2,460,657 | 2/1949 | Robinson | 72/53 |
| 3,886,774 | 6/1975 | Stromstedt et al. | 72/53 |
| 4,086,104 | 4/1978 | Kinoshita et al. | 72/53 |
| 4,100,782 | 7/1978 | Clay | 72/53 |
| 4,230,426 | 10/1980 | Avery, Jr. et al. | 72/53 |
| 4,863,091 | 9/1989 | Dubois . | |
| 5,191,911 | 3/1993 | Dubois . | |

FOREIGN PATENT DOCUMENTS

| | | | |
|---|---|---|---|
| 1005769 | 2/1977 | Canada | 72/53 |
| 659900 | 10/1951 | United Kingdom . | |

OTHER PUBLICATIONS

Understanding How Components Fail, Donald J. Wulpi American Society for Metals, 1985, pp. 74–78.

American Society for Metals, Dec. 1985—"On the Improvement of Fatigue Resistance and Safety of Butt Welds", Xiulin et al, pp. 5–8.

Tool Engineers Handbook, 1949—"Shot Peening", John C. Straub, pp. 1251–1257.

Welding Procedures and Application, L. Carl Love, 1975, p. 153

*Primary Examiner*—David Jones

*Attorney, Agent, or Firm*—Renner, Otto, Boisselle & Sklar

[57] ABSTRACT

A method of increasing the fatigue life and/or reducing stress corrosion cracking of metal coiled tubing made from a continuous length of strip material by shot peening one or both sides of the strip material along substantially the entire length of the strip material prior to milling the strip material into tubing. The continuous length of strip material is made up of individual strips welded together in end to end abutting relation and the welds are finished before the strip material is shot peened. Alternatively, or in addition to shot peening at least the side of the strip material that forms the interior surface of the tubing, the exterior surface of the tubing is continuously shot peened as the tubing is wound onto a reel or spool.

14 Claims, 2 Drawing Sheets

METHOD OF INCREASING THE FATIGUE LIFE AND/OR REDUCING STRESS CONCENTRATION CRACKING OF COILED METAL TUBING

FIELD OF THE INVENTION

This invention relates generally to a method of increasing the fatigue life of coiled metal tubing by producing small indentations or dimples in the surface of the tubing along substantially its entire length during the manufacturing process to induce compressive stresses in the tubing surface that resist low cycle fatigue caused by repeated coiling and uncoiling. Also such induced compressive stresses will resist stress corrosion cracking of the tubing which commonly occurs when the tubing is exposed to hydrogen sulfide ($H_2S$) in oil and gas wells.

BACKGROUND OF THE INVENTION

The coiled tubing of the present invention is made out of a suitable metal such as high strength low alloy carbon steel and is primarily intended to be used in the oil and gas well servicing industry. For this particular application, the tubing typically has a diameter between 1 to 5 inches and a length between 12,000 to 20,000 feet, and is wound onto a reel or spool, the diameter of which must be restricted due to transportation requirements. For this reason the plastic limits of the tubing are exceeded during the initial coiling process, and when the tubing is deployed into a well bore to different depths. Also, in many cases, upon completion of the required work, the tubing is rewound onto the spool and moved to another well for reuse. During such coiling and uncoiling, the tubing is subjected to low cycle fatigue which produces cracks that ultimately cause the tubing to fail. Also, stress corrosion cracking of the tubing commonly occurs when the tubing is exposed to hydrogen sulfide in oil and gas wells.

Due to the nature of the coiling and uncoiling operations and the strain limits of the tubing material, low cycle fatigue is unavoidable. However, to the extent that the development and growth of fatigue cracks can be retarded, the working life of the coiled tubing string will be proportionately extended. Likewise, the working life of the tubing will be extended if the stress corrosion cracking of the tubing is reduced.

SUMMARY OF THE INVENTION

The present invention relates to a method of increasing the fatigue life of a coiled metal tubing string by retarding the development and growth of fatigue cracks in the tubing during coiling and uncoiling in order to extend the working life of the tubing string. Also, the invention relates to a method of reducing stress concentration cracking of such tubing when exposed to a corrosive environment such as hydrogen sulfide.

In accordance with one aspect of the invention, small indentations or dimples are mechanically formed in the surface of the coiled tubing along substantially its entire length to induce compressive stresses in the metal surface that retard the development and growth of fatigue cracks in the coiled tubing during coiling and uncoiling and resist stress corrosion cracking thereby extending the working life of the coiled tubing.

In accordance with another aspect of the invention, substantially the entire surface of the coiled tubing is subjected to a shot peening process to induce compressive stresses in the tubing surface that resist tension stresses from coiling and uncoiling and reduce stress corrosion cracking.

In accordance with another aspect of the invention, the coiled tubing is made from a continuous length of metal strip material, the surface of which is shot peened along substantially its entire length before the strip material is milled into tubing.

In accordance with another aspect of the invention, the strip material is made up of individual metal strips welded together, and the shot peening operation is performed on one or both sides of the strip material along substantially their entire length after the individual strips are welded together and the welds are finished.

In accordance with another aspect of the invention, after the strip weld finishing and strip shot peening operations, strip material having a length substantially corresponding to the length of the tubing string to be milled is wound onto a large diameter reel prior to the milling operation.

In accordance with another aspect of the invention, substantially the entire exterior surface of the coiled tubing is shot peened after the tube milling operation to induce compressive stresses in the exterior surface that resist tension stresses from coiling and uncoiling and reduce stress corrosion cracking.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE PREFERRED EMBODIMENTS

Figure 1:
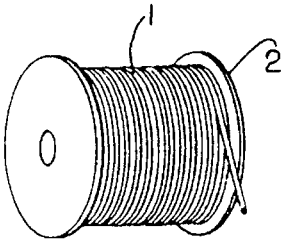
FIG. 1 is a schematic perspective view of a coiled tubing string made in accordance with the present invention wound onto a reel or spool.

Referring now in detail to the drawings, and initially to FIG. 1, there is shown a coiled tubing string 1 in accordance with this invention made from a suitable metal strip material such as high strength low alloy carbon steel strip manufactured in a continuous length and wound onto a reel or spool 2. The coiled tubing 1 is primarily intended to be used in the oil and gas well servicing industry and typically has a diameter of between 1 to 5 inches and a length between 12,000 to 20,000 feet.

The maximum diameter of the reel or spool 2 is restricted due to transportation requirements, and for this reason the elastic limits of the tubing are exceeded during the coiling and uncoiling process which results in low cycle fatigue that produces cracks on both the inner and outer surfaces of the coiled tubing in normal operations, ultimately causing the tubing to fail. Also, stress corrosion cracking of the tubing commonly occurs when the tubing is exposed to a corrosive environment such as hydrogen sulfide in oil and gas wells. However, in accordance with the present invention, small indentations or dimples are mechanically formed in the surface of the metal to induce compressive stresses in the metal surface. This drives the grains of steel closer together, thus producing "prestressing" compressive stresses in the metal which resist the action of tensile stress caused by repeated coiling and uncoiling operations and also reduce stress corrosion cracking of the tubing to extend the working life of the tubing.

Figure 2:
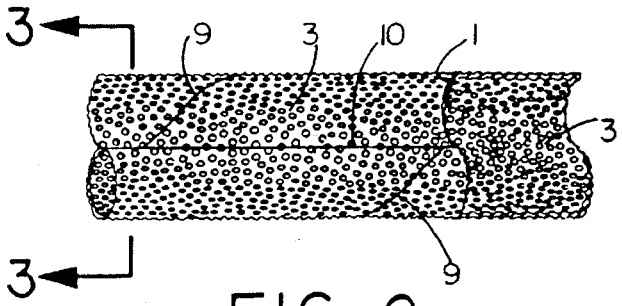
FIG. 2 is an enlarged fragmentary side elevation view, partly in section, of a portion of the tubing of FIG. 1 schematically showing small indentations or dimples in the exterior and interior surface of the coiled tubing along substantially the entire length of the tubing to induce compressive stresses in the tubing surface that resist tension stresses from coiling and uncoiling and reduce stress concentration cracking.
Figure 3:
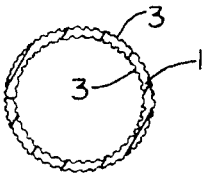
FIG. 3 is a schematic transverse section through the tubing of FIG. 2, taken generally along the plane of the line 3—3 thereof.

FIGS. 2 and 3 schematically show the mechanical indentations or dimples 3 in the tubing surface which desirably substantially cover the entire inner and outer surface of the tubing throughout substantially its entire length. In one form of the invention disclosed herein, the surface of the tubing 1 is mechanically dimpled or indented by shot peening both sides of a continuous length of strip material from which the tubing is subsequently milled as described hereafter.

Figure 4:
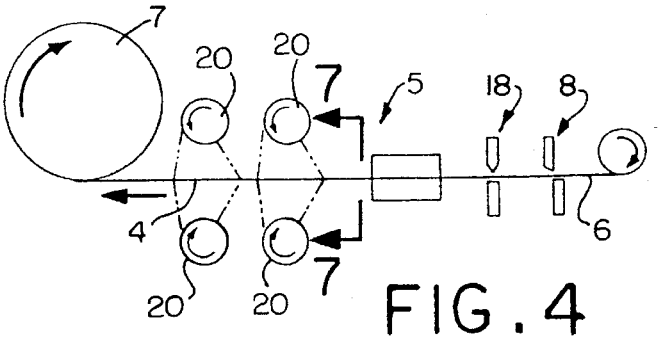
FIG. 4 is a schematic diagram of a continuous strip assembly line in which both the upper and lower surfaces of the strip material are shown being shot peened after the strip end joining and finishing operations and before the strip material is wound onto a large diameter reel prior to being milled into tubing.

A continuous length of strip material 4 is assembled in a strip assembly line 5 such as schematically shown in FIG. 4 by uncoiling individual strips 6 of sheet metal of substantially less length than the overall length of the continuous strip material to be milled, welding the ends of the individual strips 6 together, finishing the strip end welds, and then recoiling the continuous length of strip material 4 onto a large take-up reel 7 of sufficient capacity to store continuous strip material having a length substantially corresponding to a continuous length of tubing string 1 to be milled. During the strip assembly operation, a shear 8 (FIG. 4) is used to shear the strip ends to be joined at supplementary angles, preferably 45° and 135°, respectively, to place the weld 9 in the plane of maximum shear stress, i.e. 45° to the principal tension stress as schematically shown in FIG. 5, and when the strip is formed into tubing 1 with the edges of the strip welded together to form a longitudinal seam 10, the strip end weld 9 will run helically around the tubing as further schematically shown in FIG. 2.

Figure 5:
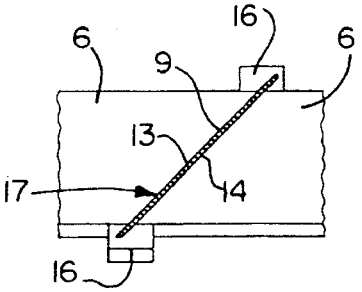
FIG. 5 is an enlarged schematic perspective view showing two strip ends welded together in the strip assembly line prior to finishing the strip end weld.

FIG. 5 schematically shows the ends of two strips 6 welded together with their abutting ends 13, 14 pressed together. To prevent burn out at the edges of the strip 6 during the welding operation, small tabs 16 of the same base material and thickness as the strips are pressed up against the ends of the joint 17 between the two strips, and either tack welded or clamped in place. Then the strip ends are welded together using a suitable strip end welder 18 (FIG. 4) such as a plasma arc welder with side wire feed or TIG welder, to make a high quality weld, moving from one of the tabs 16 along the entire length of the joint 17 and onto the other tab 16.

Upon completion of the welding, the strip end weld 9 is desirably lightly ground and X-rayed to make certain the weld is of the desired high quality so that the weld can be left in the finished tubing product without adversely affecting the fatigue life of the finished tubing product. If the weld 9 does not meet the criteria for a high quality weld, the weld is cut out and remade in substantially the same manner previously described.

Figure 6:
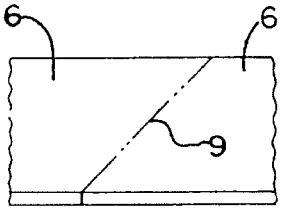
FIG. 6 is an enlarged schematic perspective view of a strip end weld similar to FIG. 5, but showing the strip end weld after the strip end weld finishing operation.

Once it is determined that the weld is of the desired high quality, the excess weld material is removed from the top and bottom sides of the strip by grinding and/or planishing the weld 9 to finish smooth the weld and make the thickness of the weld closely correspond to the thickness of the strip material. Then the weld is stress relieved, the tabs 16 are removed and the edges of the strip weld are milled square and deburred as needed to make the width of the strip material at the weld closely correspond to the width elsewhere as schematically shown in FIG. 6.

Figure 7:
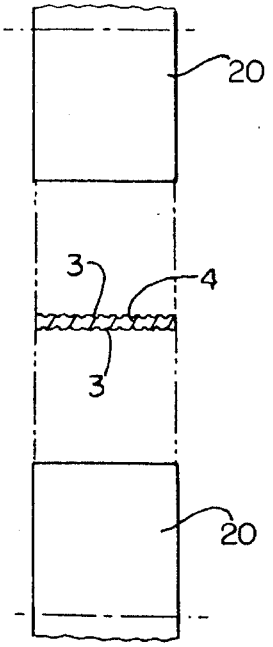
FIG. 7 is an enlarged transverse section through the strip assembly line of FIG. 4 taken generally along the plane of the line 7—7 thereof.

Upon completion of the weld finishing operation, and before the assembled strip 4 is recoiled onto the large diameter reel 7, both the top and bottom surfaces of the strip material are desirably shot peened using standard shot peening equipment such as the shot peening wheels 20 schematically shown in FIGS. 4 and 7 to produce small indentations or dimples 3 in the metal surface which produce compressive stresses in the metal surface that resist tension stresses from coiling and uncoiling the finished tubing, and reduce stress corrosion cracking, thereby extending the working life of the coiled tubing string.

The quality of the shot peening operation may be controlled in conventional manner by controlling the velocity of the shot, the hardness, size and weight of the individual shot, the angle of impact of the shot with the strip material, and the degree of coverage. The shot peening equipment used must either be adjustable for full width coverage of the strip material passing between single shot peening wheels 20 above and below the strip material, or more than one shot peening wheel 20 must be placed both above and below the strip material spaced both longitudinally and transversely from each other as schematically depicted in FIG. 4 to obtain full width coverage.

Figure 8:
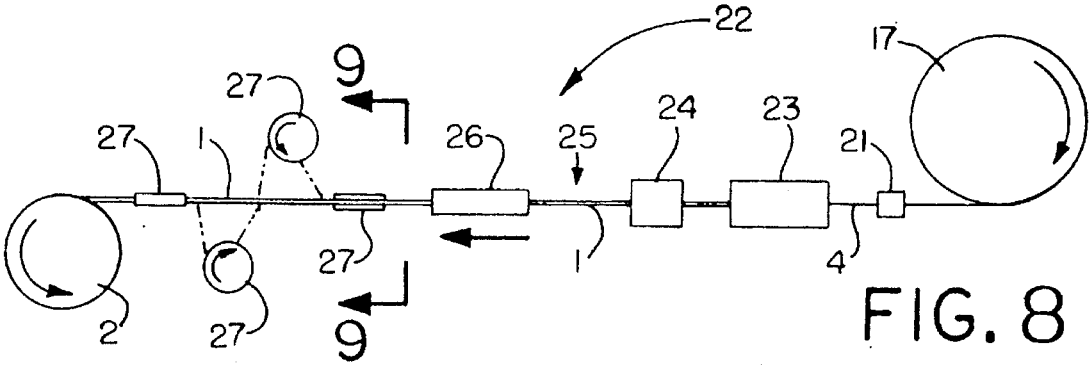
FIG. 8 is a schematic diagram of a tube mill line in which continuous strip material is milled into tubing and substantially the entire exterior surface of the tubing is shown being shot peened along substantially the entire length of the tubing as the tubing is wound onto a reel or spool.

If the strip edges themselves are deformed during the shot peening operation, a strip edge conditioning station 21 may be needed at the start of the tube mill line 22 as schematically shown in FIG. 8 to recondition the edges of the strip material to make them straight and square after the strip material is paid out from the large diameter take-up reel 7 and passed through the tube mill 23 as schematically shown in FIG. 8.

After the strip material 4 is milled into coiled tubing 1, the tubing is heat treated and both air and water cooled by passing the tubing through a suitable heat treating station 24 and air and water cooling stations 25 and 26. Then the tubing is wound onto a reel or spool 2.

Figure 9:
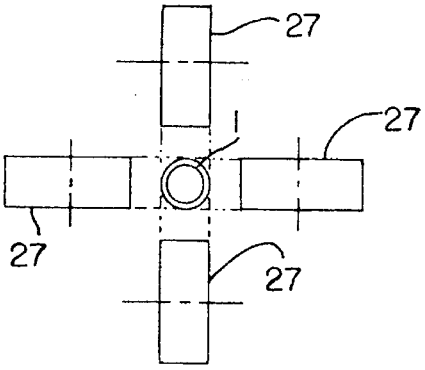
FIG. 9 is an enlarged transverse section through the tube mill line of FIG. 8 taken generally along the plane of the line 9—9 thereof.

Prior to winding the tubing 1 onto the reel 2, the entire exterior surface of the tubing 1 may be continuously shot peened by passing the tubing between a plurality of shot peening wheels 27 appropriately spaced and positioned in the tube mill line around the periphery of the tubing between the cooling station 26 and reel 2 as schematically shown in FIGS. 8 and 9. In this embodiment, four such shot peening wheels 27 are positioned 90° apart in axially spaced relation around the periphery of the tubing.

When the exterior surface of the tubing is shot peened as schematically shown in FIGS. 8 and 9, the bottom surface of the strip material 4 which becomes the exterior surface of the tubing 1 need not be shot peened after the strip weld finishing operation. In fact, the strip shot peening operation schematically illustrated in FIGS. 4 and 7 could be eliminated altogether, but that would have the disadvantage that only the exterior surface of the finished tubing would be shot peened, leaving the interior surface unpeened.

Although the invention has been shown and described with respect to certain preferred embodiments, it is obvious that equivalent alterations and modifications will occur to others skilled in the art upon reading and understanding the specification. The present invention includes all such equivalent alterations and modifications, and is limited only by the scope of the claims.

What is claimed is:

1. A method of making a continuous length of un-coated coiled metal tubing having increased fatigue life and/or reduced stress concentration cracking for use in the oil and gas well service industry comprising the steps of joining the ends of a plurality of individual metal strips to form a continuous length of strip material having a length substantially corresponding to a desired continuous length of tubing to be milled therefrom, shot peening one side of the continuous length of strip material along substantially its entire length to induce compressive stresses in such one side, continuously milling the continuous length of strip material into a continuous length of tubing with the one side of the strip material that was previously shot peened forming the interior surface of the tubing, continuously shot peening substantially the entire exterior surface of the tubing after the tube milling step to induce compressive stresses in such exterior surface, and thereafter coiling the continuous length of tubing onto a spool.

2. The method of claim 1 wherein the continuous length of strip material is built up on a storage reel and subsequently transported to a tube mill where the continuous length of strip material is unwound from the storage reel and continuously milled into tubing.

3. The method of claim 2 wherein the individual metal strips that comprise the continuous length of strip material are welded together in end to end abutting relation and the strip end welds between the individual strips are finished before the continuous length of strip material is shot peened on such one side and built up on the storage reel.

4. A method of making a continuous length of un-coated coiled metal tubing having increased fatigue life and/or reduced stress corrosion cracking for use in the oil and gas well service industry comprising the steps of making up a continuous length of strip material having a length substantially corresponding to a desired continuous length of coiled metal tubing to be milled from the strip material, the continuous length of strip material being formed by joining the ends of a plurality of individual metal strips each having one side and an other side opposite the one side, shot peening the one side of the continuous length of strip material along substantially its entire length to induce compressive stresses in such one side, coiling the continuous length of strip material onto a storage reel, and subsequently uncoiling the continuous length of strip material from the storage reel and continuously milling the continuous length of strip material into a continuous length of tubing with the one side of the strip material that was previously shot peened forming the interior surface of the tubing, and coiling the continuous length of tubing onto a spool.

5. The method of claim 4 further comprising the step of shot peening the other side of the continuous length of strip material along substantially its entire length to induce compressive stresses in such other side before coiling the continuous length of strip material onto the storage reel, such other side forming the exterior surface of the tubing during continuous milling of the continuous length of strip material into the continuous length of tubing.

6. The method of claim 4 further comprising the step of continuously shot peening substantially the entire exterior surface of the tubing after the continuous milling operation and before the continuous length of tubing is coiled onto the spool to induce compressive stresses in such exterior surface before the continuous length of tubing is coiled onto the spool.

7. The method of claim 4 further comprising the step of finishing the strip end welds between the individual metal strips before such one side of the continuous length of strip material is shot peened.

8. The method of claim 4 wherein both sides of the continuous length of strip material are shot peened along substantially the entire length of the continuous length of strip material after the ends of the individual metal strips are joined together and before the continuous length of strip material is coiled onto the storage reel.

9. The method of claim 8 wherein the ends of the individual metal strips are joined together by welding the strips in end to end abutting relation, and the strip end welds between the individual metal strips are finished before the sides of the continuous length of strip material are shot peened.

10. The method of claim 4 further comprising the step of conditioning the edges of the continuous length of strip material as the strip material is unwound from the storage reel and before the strip material is milled into tubing.

11. The method of claim 4 wherein at least approximately 12,000 feet of the continuous length of strip material is coiled onto the storage reel and subsequently continuously milled into tubing having substantially the same length as the continuous length of strip material.

12. The method of claim 11 wherein between approximately 12,000 to 20,000 feet of the continuous length of strip material is coiled onto the storage reel and subsequently continuously milled into tubing having substantially the same length as the continuous length of strip material.

13. The method of claim 11 wherein the tubing that is milled from the continuous length of strip material has a diameter of at least approximately one inch.

14. The method of claim 13 wherein the tubing that is milled from the continuous length of strip material has a diameter of between approximately one to five inches.

* * * * *